United States Patent [19]

Pluequet

[11] 4,453,511

[45] Jun. 12, 1984

[54] LUBRICATING ARRANGEMENT, ESPECIALLY FOR INTERNAL COMBUSTION ENGINES

[75] Inventor: Heinz Pluequet, Cologne, Fed. Rep. of Germany

[73] Assignee: Klöckner-Humboldt-Deutz Aktiengesellschaft, Cologne, Fed. Rep. of Germany

[21] Appl. No.: 359,907

[22] Filed: Mar. 19, 1982

Related U.S. Application Data

[63] Continuation-in-part of Ser. No. 081,215, Oct. 2, 1979, Pat. No. 4,331,112.

[30] Foreign Application Priority Data

Oct. 4, 1978 [DE] Fed. Rep. of Germany ..... 2843248

[51] Int. Cl.[3] ..... F02B 33/40

[52] U.S. Cl. ..... 123/196 S; 60/605; 184/6.3

[58] Field of Search ..... 123/196 R, 196 S; 184/6.3, 6.4; 60/605, 39.08

[56] References Cited

U.S. PATENT DOCUMENTS 3,045,420 7/1962 Addie et al. ..... 60/605
3,057,406 10/1962 Jacobson et al. ..... 123/196 A
4,126,997 11/1978 Henson ..... 60/605
4,157,744 6/1979 Capriotti ..... 123/196 S X

*Primary Examiner*—Craig R. Feinberg
*Assistant Examiner*—W. R. Wolfe
*Attorney, Agent, or Firm*—Becker & Becker, Inc.

[57] ABSTRACT

An arrangement for lubricating, especially for internal combustion engines is disclosed. The circuit of the arrangement is fed with the lubricating medium, e.g. oil, by way of a pump which delivers oil from a source, as required through an oil cooler and a filter, to bearings of the engine which require lubrication, and to more remote bearings, such as are used in auxiliary equipment, e.g. off-gas turbo-superchargers. In the main pressure conduit, relatively close to the pump, there is provided a flow control device with a direct conduit being provided to communicate the pump with the more remote bearings. The direct conduit is connected to the circuit between the pump and the flow control device. As required, an oil filter can be arranged in the direct conduit. The flow control device is controlled by the fluid pressure prevailing in front thereof to open and is spring biased to close, with a further conduit also connected to the circuit between the pump and the flow control device, communicating the pump and the flow control device.

2 Claims, 3 Drawing Figures

LUBRICATING ARRANGEMENT, ESPECIALLY FOR INTERNAL COMBUSTION ENGINES

CROSS REFERENCE TO RELATED APPLICATION

This is a continuation-in-part application of co-pending application Ser. No. 081,215-Pluequet, filed Oct. 2, 1979, now U.S. Pat. No. 4,331,112.

BACKGROUND OF THE INVENTION

1. Field of the Invention

The present invention relates to a lubricating arrangement, especially for internal combustion engines with at least one first location requiring lubrication, and at least one second location requiring lubrication, e.g. in an auxiliary equipment associated with said engine. The circuit includes a pump device adapted to convey or move the lubricating medium, e.g. oil, through a main conduit means to the locations requiring lubrication.

2. Description of the Prior Art

It is known to connect auxiliary equipment, such as for example the (exhaust) turbo-supercharger, by means of a connecting conduit to the main pressure conduit of the internal combustion engine. It is also known to arrange a drain conduit between the turbo-supercharger and the oil sump. The connecting conduit, due to the required cooling and filtering of the oil which is admitted during operation of the engine, is connected to the main pressure conduit, when viewed in the direction of flow of the lubricating oil, at a point behind the oil cooler and the oil filter, and behind other parts of the system, such as the feed-in conduits and so forth. When the engine is not operated for lengthy periods of time, the oil drains from the spaces, either in part or entirely. Thus, on restarting of the engine these spaces have to be filled again before the full oil pressure has been re-established to move the oil to the pertaining bearing locations which require lubrication. Particularly detrimentally affected are the further removed bearing locations of auxiliary equipment, for example the bearing locations of a turbo-supercharger, which are usually arranged to be at the level of the upper edge of the engine, or still further thereabove. At times, the oil is admitted to these bearing locations at a sufficient pressure after such a period of time that this delay is not of detriment at no-load running, or run-up, and correspondingly delayed, or gradual, transfer of load of the engine. However, for rapid transfer of the load as it will be the case in equipment to be operationally available at least nearly instantaneously, the point in time at which the pressure oil or lubricating oil is available in a sufficient volume will be unacceptably delayed. This can lead to serious damage and even to destruction of such bearing locations, unless by means of extensive lubricating devices it would be assured that a continuous or intermittent supply of lubricating oil is available. For most situations, however, such devices are too excessive, so that they can only be considered for larger systems.

According to the U.S. Pat. No. 4,126,997-Henson dated Nov. 28,1978, the pressure conduits to the bearing locations at the control element remain continuously open and there cannot be prevented any emptying of the pressure conduits.

The U.S. Pat. No. 3,045,420—Addie et al. dated July 24, 1962 provides an electrically operating, independent prelubricating system for the turbo charger which is operative already before motor starting. Such systems are known and special measures or features for rapid pressure build-up are not necessary herewith. Consequently, the disclosure of U.S. Pat. No. 3,045,420 cannot be considered with respect to the features of the present disclosure to be at all comparable, because of the high construction costs and complexity when compared with the teaching of the present invention which is to assure an immediate lubrication of remote bearing locations with a single lubricating pump.

The U.S. Pat. No. 3,057,436—Jacobson et al. dated Oct. 9, 1962, according to FIG. 3 shows a check valve in the conduit leading exclusively to the turbocharger which is to prevent a flowing away of lubricating oil from a storage volume. In the remaining lubricating oil system at hand there is noted that however, as expressly mentioned, empty spaces or chambers are formed which must be filled up during motor starting. The displacement of storage volume cannot occur until after the pressure build-up in these empty spaces or chambers or at least such pressure build-up is delayed thereby. Moreover the arrangement is clearly more complex and costly by way of the storage cylinder.

The U.S. Pat. No. 4,157,744—Capriotti dated June 12, 1979 on the other hand represents an isolated prelubricating device which is made functional before the motor starting period. Consequently, the disclosure of the U.S. Pat. No. 4,157,744 is not comparable with the teaching of the present invention because of the considerable structural costs and complexity thereof.

The foreign British reference No. 347,848—Tait et al. of May 7, 1931 provides a viscosity-dependent quantity control for lubrication of connecting rod bearings and consequently is not comparable with the teaching of the present invention.

SUMMARY OF THE INVENTION

It is accordingly an object of the present invention to provide an arrangement for lubricating so that the supply of the lubricating medium, or oil, for the more remote bearing locations is attained early enough and so that lubrication of such locations is attained by simple, yet effective means without detriment to the lubrication circuit.

These objects and other objects and advantages of the invention will appear more clearly from the following specification in connection with the accompanying drawings.

DETAILED DESCRIPTION

Figure 1:
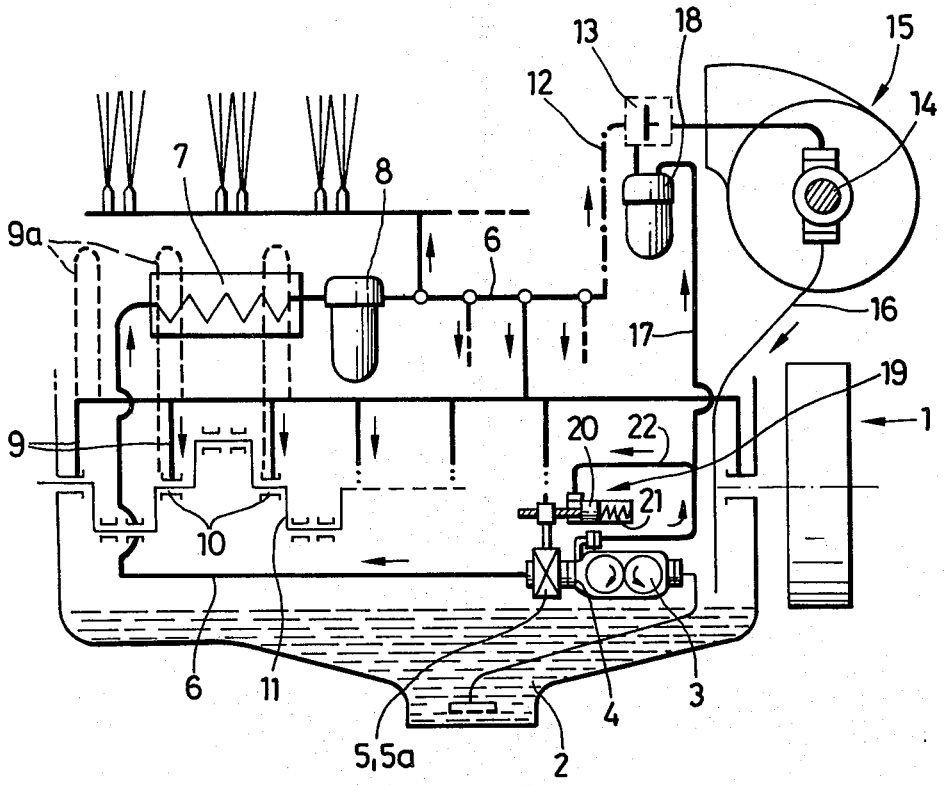
FIG. 1 diagrammatically indicates a lubricating circuit which includes features in accordance with the invention.

The arrangement for lubricating, especially for internal combustion engines, is characterized primarily therein that in the main pressure conduit, as close as possible to the pump device, there is arranged an adjustable throttle, throttle valve, or similar flow control means, and that between the flow control means and the pump device there is connected a direct pressure conduit leading, as required with interpositioning of a filter for the lubricating medium, which filter is positioned so as to be substantially drain-proof, to the more remote or second bearing locations. Furthermore, the flow control means, more particularly the actuating mechanism thereof, is connectible to a control conduit which can be subjected to the pressure which prevails in the conduit between the pump and the flow control device, for opening the flow control device which is inherently urged to its closing position by a biasing spring.

Thus, by means of the direct pressure conduit connected to the pump device, or to the main pressure conduit at a connection point closely behind the pump device when viewed in the flow direction, of the bearing locations, as required by interpositioning of a filter for the lubricating medium, which is positioned to be substantially drain-proof, lubricant will be immediately supplied to these bearing locations.

In order that the lubricant is forced through the direct pressure conduit at the initial rotations of the pump device, e.g. a lubricating oil pump, and would not select the lesser resistance of the replenishing process of the main pressure conduit, draining towards the main pressure conduit, in accordance with the prevailing conditions, can be delayed for a short period of time, or interrupted, as required, by means of the adjustable throttle, or similar control device, whereby the confluence to the main pressure conduit is fully attained with the oil pressure building up via the control conduit. After turning the engine off, however, the flow control device is moved to its closed position due to its resiliently biasing spring.

In accordance with a preferred embodiment of the invention, the control conduit of the system is connected to the direct pressure conduit which affords a constructively simple and economical arrangement of the control conduit.

In accordance with another embodiment of the invention, there is provided an arrangement wherein the direct pressure conduit leads to a connection conduit. This connecting conduit extends between the main pressure conduit and the more remote bearing locations and a switch valve is connected to the direct pressure conduit and the connecting conduit. This valve can be actuated such that at a predetermined pressure of the lubricant in said connecting conduit, the switch valve terminates the flow of lubricant through the direct pressure conduit, whereby the connecting conduit is solely adapted to convey lubricant to the more remote bearing locations; and at a predetermined low pressure of the lubricant, the valve terminates the flow of lubricant through the connecting conduit, whereby the direct pressure conduit is then adapted to convey lubricant, soley to the more remote bearing locations.

Such an arrangement will ensure that the supply of the more remote bearing locations with lubricant only during starting of the engine is effected solely by the direct pressure conduit, whereby after attaining the required speed and on attaining sufficient pressure in the main pressure conduit, the lubricant supply is provided through the latter. This will ensure that, during normal operation of the engine, all bearing locations are supplied with cooled, and as required, by filtered lubricant. When the volume of lubricating medium flowing through the direct pressure line is relatively small and when the more remote bearing locations can be subjected to a somewhat warmer not re-cooled lubricating medium, heated due to operation of the motor, the direct pressure conduit can be used to feed the lubricant during the entire operation of the motor, and the usual connecting conduit between the main pressure conduit and the bearing locations can be avoided.

In accordance with another preferred embodiment of the invention, in the main pressure conduit there is arranged, as close as possible to the pump device, an adjustable flow control device. This flow control device is urged to its closed position by a spring, and is adapted to be actuated to assume its open position by the pressure prevailing in the main pressure conduit between it and the pump device. The means for cooling oil, the means for filtering oil, other spaces, the main pressure conduit with side chambers, and at least short sections of feeder lines are all arranged in relation to the at least one first bearing location requiring lubrication so as to be substantially drain-proof. Thus, when the bearing locations are drain-proof, the lubricant, i.e. oil, could return only through the main pressure conduit; however, this is prevented by the flow control device. Drain-proofing can be assured thereby that at least short sections of the feeder lines of the main pressure conduit and the pertaining side chambers and the like leading to the bearing locations, are arranged so that the highest point thereof is higher than all other chambers or the like spaces of the system. Thus, even when then the connecting conduit leading from the main pressure conduit to the more remote bearing locations, for example of the super-turbocharger, should have become drained due to lower bearing locations, nevertheless, due to the oil pressure which is building up when the flow control device is opened and due to the filled oil spaces, the increase of pressure in the connecting conduit would be carried out as rapidly as the case would be if a direct pressure conduit were employed.

Referring now particularly to FIG. 1 of the drawing, the numeral 1 designates a diagrammatically indicated combustion engine. Engine 1 has an oil sump 2 from which oil or a similar lubricating medium can be brought into a conduit 6 by a means of a pump 3. At the output or pressure end 4 of the pump 3 there is arranged a throttle, valve or other similar flow control device, designated by a numeral 5, which is also operatively connected to the conduit 6, this conduit also being referred to as main pressure conduit. As required, a means 7, and a means for filtering oil, such as filter 8, are arranged in the conduit 6. Feeder lines 9 are in communication with the conduit 6, which feeder lines 9 lead to bearing locations 10, also referred to as first, or bearing, locations requiring lubrication. The bearings 10 are provided for a crank shaft 11 and other similar parts. The main conduit 6 is furthermore in communication with a connecting conduit 12 which is adapted to bring the oil to more remote bearing locations, also referred to as second, or bearing, locations requiring lubrication, generally designated by numeral 14 of an auxiliary equipment, e.g. a turbo-supercharger 15.

A drain conduit 16 leads from the remote bearing location 14 to the sump 2. A direct pressure conduit 17 is connected to the output end 4 of pump 3, which conduit 17 leads to a switch valve or similar flow control device, generally designated by the numeral 13 and connected in the connecting conduit 12. As required, a filter 18 can be provided in conduit 17, which filter is located so as to be substantially drain-proof. The flow control device 13 is adapted to be actuated so that when the connecting conduit 12 is pressurized, i.e. when the oil is moving towards the remote bearing locations 14, it is open, while at low pressure, or no pressure in this connecting conduit 12, the valve 13 closes this conduit 12. This latter condition is indicated in the drawing. The direct pressure conduit 17 then feeds the lubricating medium to the more remote bearing locations 14.

The flow control device 5 is actuated by means of an auxiliary cylinder 19 having a piston 20. The piston 20 is biased by a spring 21 on the one hand, and by means of a control conduit 22 by the pressure in the direct conduit 17 on the other hand so that when conduit 17 is pressureless, or when a low pressure exists in the direct conduit 17, the flow control device 5 is closed, while a sufficient pressure in conduit 17 will serve to open the flow control device 5.

The drawing further indicates in dot-dash outline feeder lines 9*a* for three first bearing locations 10 of the crank shaft 11. These feeder lines 9*a* are arranged so that each includes a section which is located higher than the main pressure conduit with side chambers and the like. Thus, when use is made of such feeder lines 9*a* and of a flow control device 5*a*, the direct pressure conduit 17 need not be employed.

Under certain circumstances, the present invention comprises a pressure-controlled blocking valve in the main pressure oil conduit as well as features against having the conduits emptying so that without filling up of empty spaces there can occur an immediate pressure build-up. The conduit system under these circumstances is in essence non-branched or without branches which means a separate direct pressure oil conduit is not provided from the lubricating oil pump to the turbo charger. Such as arrangement is not included in the prior art.

Another aspect of the present invention relates to a system with a separate, direct pressure oil conduit from the lubricating oil pump to the turbo charger.

An effective, rapid application of lubrication according to the first principle for resolving the object of the present invention solely is to be assured thereby that a flowing-off from the main pressure oil conduit through an oil-pressure-dependent control closure element at the lubricating oil pump and an arrangement of the bearings protected against running-out of the lubricant can be considered to be an extremely effective measure or feature with simple means for doing so. Such application of lubrication is not in any way obvious since, already with the motor construction, the arrangement of the bearings, conduits, filter and cooler must be provided as protected against running-out of lubricant. Consequently, at first a considerable cost and complexity must be provided in order in a series or mass production to attain a simple and cost-advantageous solution. The concept of this combination is clearly an inventive contribution.

Now with respect to the features according to the present invention, the arrangement involves a direct pressure conduit from the oil pump to the turbo charger through which the second principle of solution of the object of the present invention is represented and for which primary importance is attributed to gain protection.

In the U.S. Pat. No. 4,126,997, the main pressure oil conduit 26 to the lubricating location of the motor is continuously opened. This conduit has a larger cross section than the direct pressure oil conduit to the turbo charger so that with still nominal oil pressure initially by way of this conduit first the hollow spaces or chambers which have emptied in the lubricating oil system of the internal combustion machine are filled up. According to the present application in contrast to and in combination with the main features to be covered in a divergent manner, the entire motor lubricating oil system is blocked off from the oil supply which at this time point alone is used for supplying the remote bearing locations. At first with sufficient supply of these bearing locations with now build-up lubricating oil pressure is there released or made possible the supply of the bearing locations of the combustion engine. This is not at all obvious by way of the U.S. Pat. No. 4,126,997 since surprisingly and with certainty it seemed dangerous for the average man skilled in the art to interrupt the supply of lubricant for the main bearings even if also only briefly doing so. The interruption of the conduit to the spray-oil cooling with a still cold motor in contrast according to the U.S. Pat. No. 4,126,997 seems apparent and not surprising for the expert or average man skilled in the art and consequently this measure cannot in any way lead to the teaching of the present invention.

Figure 2:
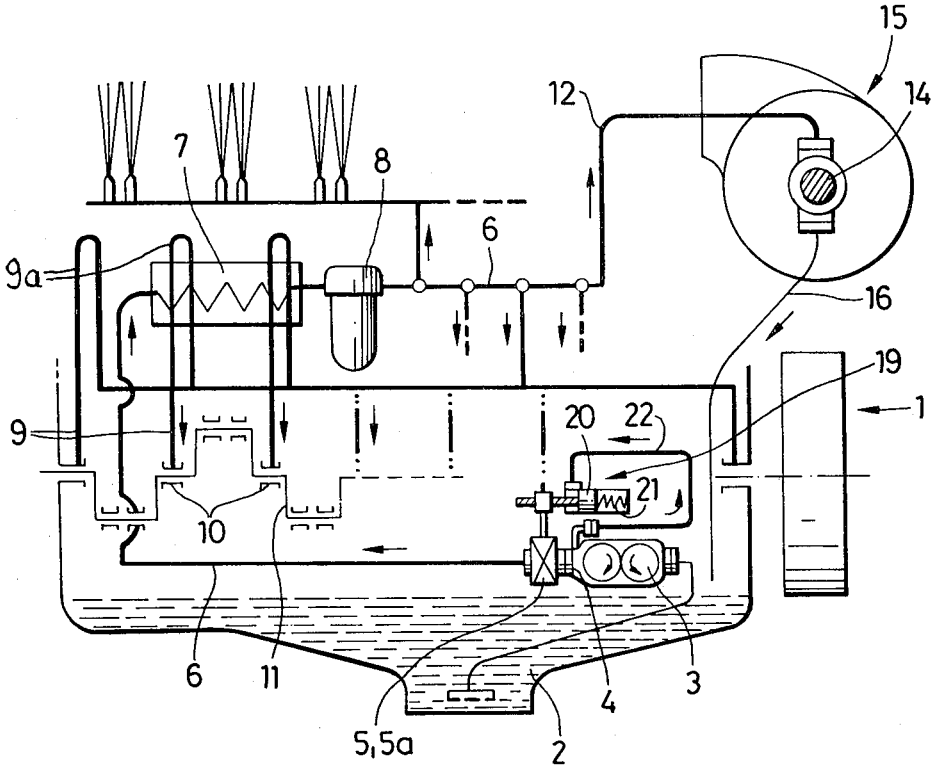
FIG. 2 diagrammatically indicates a lubricating circuit similar to that of FIG. 1 with portions thereof eliminated therefrom.
Figure 3:
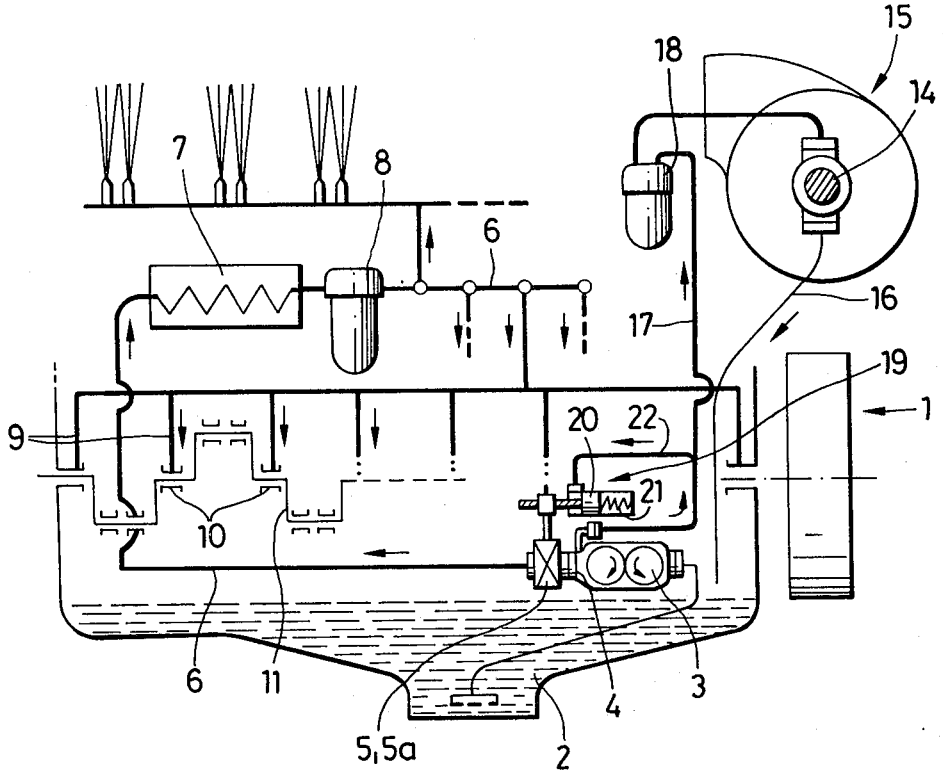
FIG. 3 also diagrammatically indicates a lubricating circuit modification with optional features eliminated therefrom.

The U.S. Pat. No. 3,057,436 shows in the embodiment of FIG. 2 thereof likewise a direct conduit connection between the lubricating oil pump and turbo charger though also hereby, however, the main pressure conduit remains continuously open by way of the oil cooler and filter to the lubricating locations of the combustion machine so that in the starting phase likewise considerable lubricating medium quantities flow away this conduit, which results therein that the emptied hollow spaces or chambers therewith must be filled up again. The lubricating medium supply at the turbo charger is furthermore likewise insufficient therewith. The embodiment according to FIG. 3 shows a completely different principle of solution of the object in that a direct conduit connection between the lubricating oil pump and turbo charger does not exist at all. The pressure-build-up in the servo-element which is to be served for rapid lubrication of the turbo charger, is however here again influenced thereby that the main pressure oil conduit is also opened in the starting phase and the main quantity of the lubricating medium in the previously mentioned hollow spaces or chambers in the oil cooler, filter and lubricating oil system of the combustion macnine flow away.

An especially advantageous embodiment of the present invention exists via a special connection conduit between the main pressure oil conduit and the turbo charger and a further control element as well as furthermore the bearing locations of the turbo charger in an advantageous manner subject to eliminating a further oil filter also are supplied in a continuous operation with filtered and cooled lubricating oil.

The features of the present invention should be considered especially with the limitation and distinction thereof compared with the Henson U.S. Pat. No. 4,126,997 in that the throttle, valve or flow control device so far as provided or existing therewith is located directly at the pump and moreover before the oil cooler and the oil filter. The flow control device behind the pump can preferably be a check valve or non-return flap.

The balanced embodiment with pressure actuated adjustment device accordingly is illustrated by dash lines. The dash lines to the bearings in a preferred embodiment are drawn or illustrated above the height or level of the cooler and filter which is to prevent or preclude that the main oil line or conduit runs empty. The direct tie lines or tap lines accordingly are likewise illustrated only as dash lines.

The system in FIG. 1 is modified by elimination of the direct connection conduit 17, of the filter 18 and of the control valve 13 with simultaneous solid or full-line representation of conduits *9a* and 12; this represents main features to be covered herewith. In FIG. 3, the dotted or dash portions have been taken out which were optional as already apparent in the drawing; thus FIG. 3 represents a dependent aspect of the present disclosure since in both situations of FIGS. 2 and 3 there have been taken out only predetermined or particular parts, the aspects thereof are also advantageous.

The present invention is, of course, in no way restricted to the specific disclosure of the specification and drawing, but also encompasses any modifications within the scope of the appended claims.

What is claimed is:

1. A lubricating arrangement for an exhaust turbo-supercharger, especially for an internal combustion engine with at least one first location requiring lubrication, and at least one second location requiring lubrication in an auxiliary equipment associated with said engine, said at least one second location being remote from said at least one first location, said arrangement in combination comprising:

a main conduit means for communicating said at least one first location and said at least one second location with a source of lubricating medium, said main conduit means including a main pressure conduit;

a single pump device operatively connectible to said main conduit means and adapted to convey a lubricating medium immediately from said source thereof to said at least one first location and said at least one second location; and an adjustable flow control device operatively connected to said main pressure conduit, said adjustable flow control device being arranged in the main conduit means directly after said pump device and as close as possible to said pump device between said pump device and said at least one first location, said flow control device being securely and inherently urged to its closed position to protect against any running empty of the lubricating arrangement during a gradual stopping of said engine as well as during standstill thereof and being actuatable to assume an open position for lubricant supply maintained absolutely during entire operation thereof only by the pressure in said main pressure conduit between said flow control device and said pump device without any lubrication resulting directly from said pump device to the exhaust turbo-supercharger.

2. A lubricating arrangement in combination according to claim 1, which includes a separate direct pressure conduit, operatively connected between said pump device and said flow control device, for conveying said lubricating medium to said remote at least one second location requiring lubrication.

* * * * *